United States Patent [19]

Baer

[11] Patent Number: 4,561,136

[45] Date of Patent: Dec. 31, 1985

[54] SHOWER TRACK

[76] Inventor: Martin D. Baer, 1816 Cedar Hill Rd., Norman, Okla. 73069

[21] Appl. No.: 687,774

[22] Filed: Dec. 31, 1984

[51] Int. Cl.[4] ..... B05B 3/18

[52] U.S. Cl. ..... 4/615; 4/191

[58] Field of Search ..... 4/615, 191, 192, 601, 4/605; 239/282, 283

[56] References Cited

U.S. PATENT DOCUMENTS

| | | | |
|---|---|---|---|
| 2,685,093 | 8/1954 | Lunquist | 4/191 |
| 3,005,995 | 10/1961 | Bickford | 4/191 |
| 3,616,466 | 11/1971 | Davis | 4/191 |
| 3,737,107 | 6/1973 | Wright | 4/615 |
| 4,360,159 | 11/1982 | Haynes | 4/601 |

*Primary Examiner*—Stephen Marcus
*Assistant Examiner*—Leo James Peters
*Attorney, Agent, or Firm*—Fowler, Lambert & Hackler

[57] ABSTRACT

An adjustable shower head assembly is provided which includes a minimum of parts for enabling the adjustment of a shower head to accommodate persons of varying stature. A housing including a front panel, having a slot therein, is provided along which a conventional-type shower head is adjustably mounted therealong, the position of the shower head being maintained at any preselected position along the slot by a flexible hose which is contained within the housing by interior surfaces of the housing sides. The interior surfaces, in effect, provide abutment and a guide means for restricting the shape and position of the hose within the housing. In addition, the force of water through the hose during operation of the shower head exerts sufficient pressure against the housing sides to stabilize the shower head along the slot, despite the forces generated against the shower head by exiting water.

5 Claims, 4 Drawing Figures

SHOWER TRACK

This invention generally relates to shower accessories and is more particularly directed to an adjustable shower head assembly for use in various bath and shower enclosures.

A large number of shower track assemblies have been fabricated and sold over the years for accommodating for the varying stature of individual users for use both in the home and in commercial establishments, such as apartments and hotels.

A great number of these prior art devices, as represented by U.S. Pat. No. 4,142,272 to Mace, U.S. Pat. No. 4,174,822 to Larsson, and U.S. Pat. No. 4,271,543 to Martin have been directed to open or exposed apparatus for attachment to a shower wall and typically utilize a bar, or the like, onto which a conventional shower head may be adjustably attached.

These devices, however, may be unsightly in appearance and, although typically constructed of chrome-plated metal, soon become worse looking because of the erosion of the chrome-plate, and rusting of the base materials if they are fabricated from iron-based alloys.

It is, therefore, desirable to provide an adjustable shower head assembly suitable for use in existing bath and shower enclosures, which is easily maintained, while at the same time providing an attractive decoration for the bathroom.

Attempts to provide such an enclosed adjustable shower head, or assembly, include those disclosed in U.S. Pat. No. 3,737,107 to Wright, and U.S. Pat. No. 4,360,159 to Haynes.

While the concept of providing an adjustable shower head assembly in an enclosed structure to thereby provide an attractive shower accessory is not new, as evidenced by the hereinabove-referenced U.S. patents, specific implementation of the idea, in view of the moist shower environment, including mineral-laden water, is not easily accomplished, particularly if the device is to have any significant useful life.

Devices such as shown in U.S. Pat. Nos. 3,737,107 and 4,360,159, have a significant amount of internal structure and mechanism necessary for adjusting the shower head within the closed housing. It is readily apparent that water entering the housing, either directly or by deflection from the individual utilizing the shower, accumulates within the housing, thereby providing a suitable environment for mold to develop as well as depositing minerals on the internal structure of the shower adjustment apparatus to interfere with its movement for adjusting the shower head if not causing a total binding or seizing of the apparatus over a short period of time. One need only to observe the corrosion in buildup of deposits on typical bathroom handles, spouts, and shower heads to actualize this problem.

In U.S. Pat. No. 3,737,107, an attempt was made to prevent water from entering the structure by means of a flexible shower slide associated with the shower head to prevent water from entering the housing through a slot in which the shower head is adjusted. This provision, however, further complicates the shower device mechanism and, in addition, provides still more crevices and cooperating movable parts, which can be contaminated and clogged by the minerals deposited thereon by impinging shower water.

It is further evident that such complicated structure associated with the hereinabove-referenced prior art enclosed shower head assemblies not only limits the useful life of the apparatus, but also contributes significantly to the manufacturing cost of the device.

It is also apparent from the complex internal mechanism utilized in the prior art that the housing for containing and concealing the mechanism must be necessarily large and protrude from the shower wall a considerable distance.

This protrusion may not be desirable both from a point of view of appearance and interference with an individual using the shower because of the confined nature of most shower enclosures.

There is a need, for which prior art devices have been unsuccessful in satisfying, for a simple, durable long life adjustable shower head assembly, which is an attractive and functional accessory for bathrooms and showers in the home, as well as in commercial establishments, such as apartments and hotels.

The present invention fills such a need in that it provides for an attractive, easily maintained adjustable shower head assembly having few parts for enabling the adjustment of a shower head to accommodate persons of varying stature, which can provide a long service life without the need for meticulous cleaning thereof due to the enclosed nature of the apparatus.

SUMMARY OF THE INVENTION

In accordance with the present invention, a shower track assembly includes a housing having means defining a slot in a front panel thereof with the housing also including a pair of sides attached to the front panel and means for attaching the sides to a shower wall over a shower head outlet. Also provided are a shower head and means for adjustably mounting the shower head along the slot for enabling adjustment of the height of the shower head from a shower floor when the housing is mounted to a shower wall with the slot in a generally vertical orientation. The front panel may be removably attached to the sides to enable access to an inside of the housing.

A flexible hose is provided for interconnecting the shower head outlet and the shower head, with the shower hose being disposed behind the housing front panel and between the housing sides and having a preselected length and radius of curvature to enable the shower head to be positioned along the slot from one end of the slot to another end of the slot while the flexible hose maintains contact with both of the housing sides.

In this manner, the sides include and provide abutment and guide means for containing the flexible hose within the housing, enabling the shower head to be positioned along the slot from one end of the slot to another end of the slot and also stabilizing the shower head along the slot when water is flowing therethrough.

Because the hose is concealed behind the front face and within the sides, no unsightly or dangling hose is observable to the shower user, as occurs with many exposed adjustable shower track systems.

The abutment and guide means support the flexible hose in a generally U-shaped configuration within the housing and the hose means has sufficient resilience to enable movement of the shower head along the slot and also stabilize the shower head along the slot during water flow through the shower head by exerting force against the housing sidewalls.

Additionally, the front panel and the sides define a passageway through the housing from the top to the bottom of the housing for enabling air and water to flow through the inside of the housing when the housing is attached to a shower wall.

This passageway not only allows the bulk of water entering the housing through the slot or through an open top of the housing to pass therethrough, it also provides air circulation through the housing to enable fast drying of the housing inside, which significantly reduces the moist environment therein and, consequently, results in significantly less buildup of mold therein after periodic use of the shower. The means for slidably mounting the shower head along the slide includes a bracket disposed behind the housing front panel, which slidably engages the housing sides by way of track means disposed therein.

In effect, not only do the sides and front panel cooperate to provide an operative means for guiding the flexible hose within the housing, as the shower head is moved along the slot, but the sides have a preselected width for supporting the front face in a spaced-apart relationship with the shower wall to cause the flexible hose to generally align itself in a plane parallel to the shower wall.

In this manner, movement of the hose within the housing is controlled and no entanglement occurs which may interfere with the movement of the shower head along the slot.

This is a significant improvement over the complex arrangements utilized in the prior art to control a hose within a housing. Since there are no pulleys or other complicated mechanical devices for guiding the hose, there is appreciably less opportunity for the buildup of mineral deposits and mold, which can, upon accumulation thereof, interfere with the operation of the adjustable feature of the shower head.

The housing sides are spaced apart from one another to enable mounting of the housing over a shower outlet at a position so that the shower head may be moved therepast without interference therewith. This feature enables the housing to be mounted over a shower head outlet to either provide increased elevation of the shower head, decreased elevation of the shower head, or an equal adjustment of the shower head past the shower outlet, as may be desired by the individual user and the specific distance above the shower floor at which the shower outlet exists.

To provide a relatively low profile for the housing, a first elbow-type coupling may be provided for connecting one end of the flexible hose to the shower outlet, and the second elbow-type coupling may be provided for connecting another end of the flexible hose to the shower head.

BRIEF DESCRIPTION OF THE DRAWINGS

The advantages and features of the present invention will appear from the following description when considered in conjunction with the accompanying drawings, and which.

DETAILED DESCRIPTION

Figure 1:
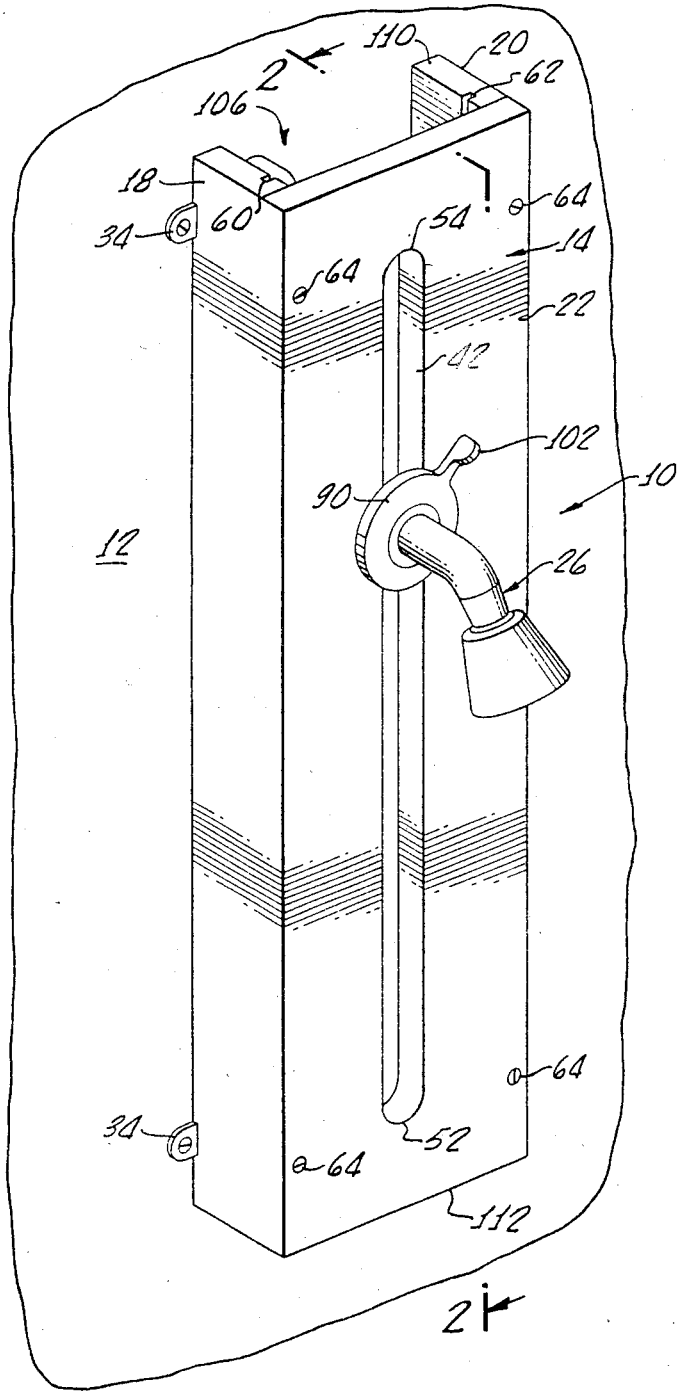
FIG. 1 is a perspective view of a shower track assembly in accordance with the present invention generally showing a housing supported on the shower wall having a slot in a front panel thereof in which a shower head is mounted for adjustable movement therealong.
Figure 2:
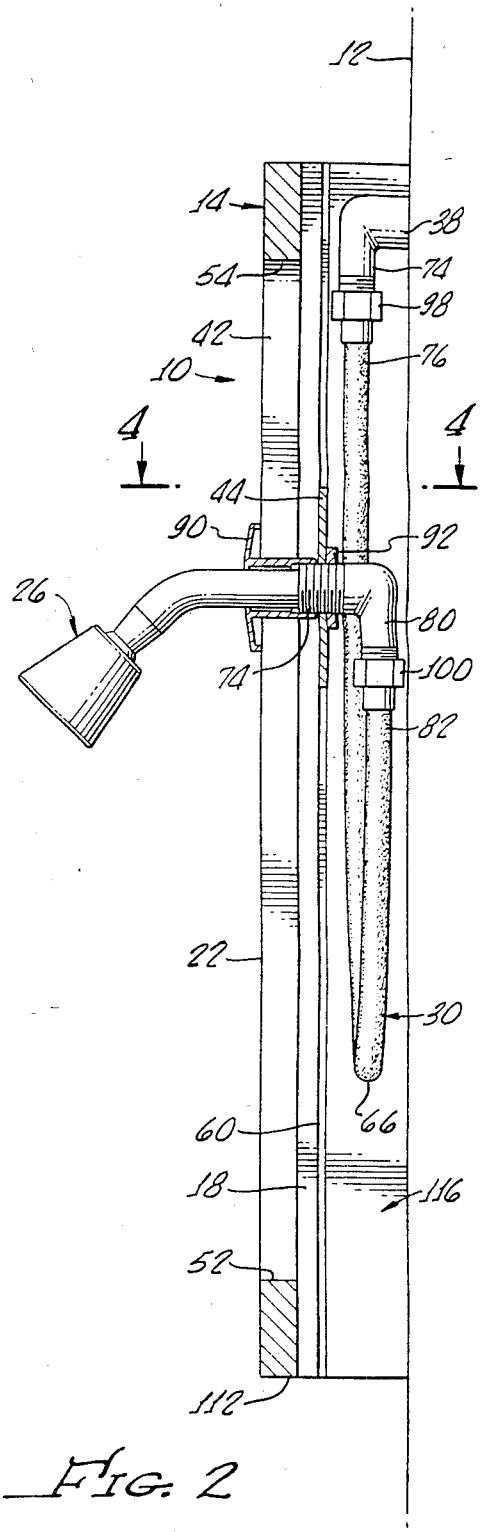
FIG. 2 is a cross-sectional side view of the shower track assembly showing more clearly a flexible hose interconnecting the shower head with a shower outlet, with the flexible hose generally aligned in a plane parallel to the front panel of the housing.

Turning now to FIGS. 1 and 2, there is shown a shower track assembly 10 disposed on a shower wall 12 and generally showing a housing 14 having a pair of sides 18, 20 and a front panel 22, a shower head 26, a flexible hose 30 and brackets 34, which provide a means for attaching the sides 18, 20 to the shower wall 12 over a shower head outlet 38. It should be appreciated that the housing sides 18, 20 may be glued to the shower wall 12 if it is not desired to drill holes thereinto.

Figure 3:
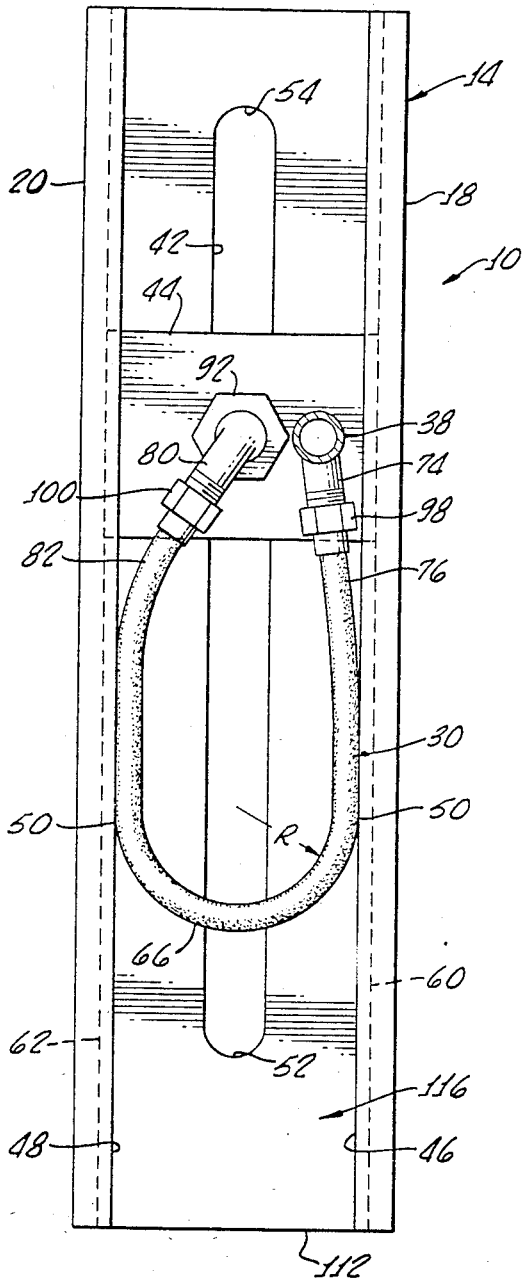
FIG. 3 is a rear view of the shower track assembly showing the housing mounted in a position relative to the shower outlet so that the shower head can be adjusted both above and below the shower outlet and also showing the flexible hose being supported in a generally U-shaped configuration within the housing and contacting both the housing sides despite the position of the shower head within the slot, which provides a means for stabilizing the shower head along the slot while water is flowing therethrough; and, FIG. 4 is a cross-sectional view taken along the line 4—4, FIG. 3, generally showing the relative positions of the shower outlet and the shower head.
Figure 4:
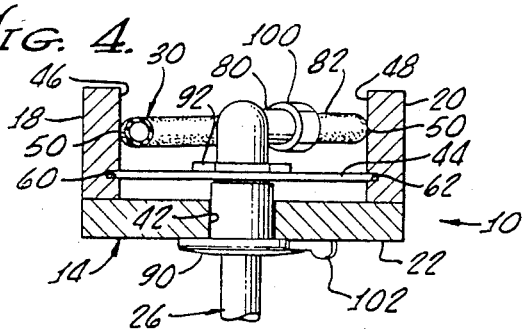

A slot 42 is provided in the front panel 22 of the housing 14 and, as shown more clearly in FIGS. 3 and 4, means, including a support bracket 44, are provided for slidably mounting the shower head 26 along the slot 42 to enable an adjustment of the height of the shower head from a shower floor, not shown, when the housing 14 is mounted to the shower wall 12 with the slot 42 in a generally vertical orientation.

As most clearly shown in FIG. 3, the sides 18, 20 include inside surfaces 46, 48, which provide abutment and guide means for containing the flexible hose 30 within the housing 14. This enables the shower head 26 to be positioned along the slot 42 from one end 52 to another end 54 of the slot and, importantly, stabilizing the shower head 26 along the slot when water is flowing therethrough.

As is shown in FIG. 3, the surfaces 46, 48 support the flexible hose 30 in a generally U-shaped configuration within the housing 14. A number of flexible hoses may be employed in accordance with the present invention, depending, of course, on the spacing between the sides 18, 20 and the overall length of the slot 42. Without undue experimentation, it can be determined, from the dimensions adopted for the shower track assembly housing 14, the proper characteristics of the flexible hose, such as the hose resilience and minimum radius of curvature, R, to enable movement of the shower head along the slot, while at the same time enabling the flexible hose to stabilize the shower head 14 along the slot 42 during water flow through the shower head by exerting force against the housing sidewall surfaces 46, 48 along contact areas 50.

As best shown in FIG. 4, the bracket 44, which provides means for slidably mounting the shower head 26 along the slot 42, extends between the sides 18, 20, and each side 18, 20 includes a slot, or track, 60, 62 for slidably engaging the bracket 44.

It is apparent, therefore, that the sides 18, 20, including the interior surfaces thereof 46, 48, cooperate with the front panel 22 to provide an operative means for guiding the flexible hose 30 within the housing 14, as the shower head 26 is moved along the slot 42.

An advantage of the relatively simple configuration of the present invention lies in the fact that the hose is confined and supported, so that in operation, i.e., during water flow through the hose 30 and shower head 26, it does not move about within the housing, thus providing silent operation of the assembly. This may not be the case with regard to prior art devices which incorporate complex mechanisms, such as pulleys, or the like, which may be spring loaded to cause tensioning of the hose.

The front panel 22 may be removably attached to the sides 18, 20 by means of screws 64, or the like, to enable access to the hose 30 for replacement thereof or for cleaning the interior of the housing 14.

The housing sides 18, 20 are spaced apart from one another to enable mounting of the housing 14 over the shower outlet 38 at a position so that the shower head 26 may be moved therepast without interference therewith. It is to be appreciated that this spacing is also an important consideration as hereinbefore discussed with regard to containing the hose 30 in a U-shaped configuration between the inside surfaces 46, 48 of the sides 18, 20.

As should be evident from FIG. 3 and 4, as water passes through the flexible hose 30, the pressure therein tends to straighten the hose along a curved portion 66, which thereby exerts outward pressure against the surfaces 46, 48, which accordingly prevents movement of the shower head 26 during water flow therethrough.

It would be natural to expect an upward movement of the shower head 26 during operation because of the downward ejection of water therefrom. However, the force exerted by the hose against the interior surfaces 46, 48 prevents such movement.

As hereinbefore pointed out, the radius of curvature R and the resilience of the flexible hose 30 when water is not flowing therethrough enable adjustment of the shower head 26 along the slot 42 and maintain such adjustment by exerting force against the surfaces 46, 48, even when water is not flowing therethrough.

As most clearly shown in FIG. 4, the housing sides 18, 20 have a preselected width extending between the shower wall 12 (not shown in FIG. 4), and the front panel 22 to support the front panel in a spaced-apart relationship with the shower wall to cause the flexible hose to generally align itself in a plane parallel to the shower wall.

In order to maintain a low profile of the housing against the shower wall 12, a first elbow-type coupler 74 provides means for connecting one end 76 of the hose 30 to the shower outlet 38 and a second elbow-type coupler 80 provides means for connecting another end 82 to the shower head 26. The first and second elbow-type couplers 74, 80 are generally disposed in a plane parallel to the shower wall 12 in order to enhance the low profile feature of the present invention.

The shower head 26 may be of any conventional design having threads, not shown, thereon for engaging the elbow 80.

The elbow 80, as well as the shower head 26, is slidably mounted along the slot 42 by means of a collar 90 and a nut 92 which engages exterior threads 94 on the elbow 80.

Connections between the elbows 74, 80 and the hose ends 76, 82 may be made in any conventional manner, as for example, compression fittings 98, 100, as shown in the FIG. 2, 3 and 4.

It should be appreciated that the passage of time may affect the resiliency of the flexible hose 30, and, hence, the hose may not, at a later time, support the shower head 26 at a preselected position along the slot 42, when water is not flowing through the hose 30. In anticipation of this possibility, the collar may be provided with an ear, or handle, 102 to enable tightening of the collar against the front panel 22 to adjustably secure the shower head 26 along the slot 42.

Importantly, the housing 14, which includes the sides 18, 20 and the front panel 14, provides means for defining a passageway 106 through the housing 14 from a top 110 to a bottom 112 for enabling air and water to flow through the inside 116 of the housing 14, when the housing is attached to the shower wall 12.

As hereinbefore pointed out, this passageway 116 not only allows the bulk of water entering the housing through the slot 42 or through the open top 110 of the housing to pass therethrough, it provides for ample air circulation through the housing 14 to enable fast drying of the housing inside 116 which consequently results in a reduced amount of moisture therein and a reduced possibility for the growth of mold therein.

The housing 14 may take many decorative shapes, as allowed by its low profile nature, and be formed of a cast or molded plastic or fiberglass material.

Although there has been described hereinabove a specific arrangement of a shower track apparatus in accordance with the present invention for purposes of illustrating the manner in which the invention may be used to advantage, it will be appreciated that the invention is not limited thereto. Accordingly, any and all modifications, variations or equivalent arrangements, which may occur to those skilled in the art, should be considered to be within the scope of the invention as defined in the appended claims.

What is claimed is:

1. A shower track assembly comprising:

a housing having means defining a slot in a front panel thereof, said housing including a pair of sides attached to the front panel and means for attaching said pair of sides to a shower wall over a shower head outlet, said sides including abutment and guide means for containing a flexible hose within the housing in a generally U-shaped configuration for enabling a shower head to be positioned along said slot from one end of the slot to another end of the slot, and for stabilizing the shower head along the slot when water is flowing therethrough:

a shower head;

means for slidably mounting said shower head along the slot for enabling adjustment of the height of the shower head from a shower floor when the housing is mounted to a shower wall with the slot in a generally vertical orientation, said means for slidably mounting said shower head along the slot including bracket means disposed behind said housing front panel for slidably engaging said housing sides; and flexible hose means for maintaining the position of the shower head along the housing slot, said flexible hose means interconnecting said shower head and disposed behind said housing front panel and between said housing sides, said flexible hose means having a preselected length and radius of curvature to enable the shower head to be positioned along said slot from one end of the slot while the flexible hose maintains contact with both said housing sides, said flexible hose means having sufficient resilience to enable movement of said shower head along the slot and to stabilize the shower head along the slot during water flow through the shower head by exerting force against the housing side walls.

2. The shower track assembly of claim 1 wherein said housing sides include slot means for slidably engaging said bracket means.

3. A shower track assembly comprising:

a housing having means defining a slot in a front panel thereof, said housing including a pair of sides attached to the front panel and means for attaching said pair of sides to a shower wall over a shower head outlet, said sides and front panel co-operating to provide operative means for guiding flexible hose within the housing as a shower head is moved along the slot, said side have a preselected width for supporting the front panel in a spaced apart relationship with the shower wall, said spaced apart relationship being sufficiently close to cause said flexible hose to generally align itself in a plane parallel to the shower wall;

a shower head;

means for slidably mounting said shower head along the slot for enabling adjustment of the height of the shower head from a shower floor when the housing is mounted to a shower wall with the slot in a generally vertical orientation;

said means for slidably mounting said shower head along the slot including means for releasably securing the shower head against the front panel, said last mentioned means including a threaded collar for tightening the basket against the front face, said front panel being removable to enable access to said flexible hose and first and second coupling means;

flexible hose means for maintaining the position of the shower head along the housing slot, said flexible hose being supported by the housing sides in a generally U-type shape with one end of the hose connected to the shower outlet and another end of the hose connected to the shower head, said flexible hose means interconnecting said shower head and disposed behind said housing fron panel and between said housing sides, said flexible hose means having a preselected length and radius of curvature to enable the shower head to be positioned along said slot from one end of the slot to another end of the slot while the flexible hose maintains contact with both said housing sides, said flexible hose means including first elbow type coupling means for connecting said on end of the flexible hose to the shower outlet and second elbow type coupling means for connecting said another end of the flexible hose to the shower head, said first and second elbow-type coupler means being generally disposed in a plane parallel to the shower wall.

4. A shower track assembly comprising:

a housing having means, including a front panel and a pair of sides, for defining a passageway therethrough from a top to a bottom of the housing for enabling air and water to flow through an inside of the housing when the housing is attached to a shower wall, said front panel including means defining a slot therein; said sides including abutment and guide means for containing a flexible hose within the housing for enabling a shower head to be positioned along said slot from one end of the slot to another end of the slot, and for stabilizing the shower head along the slot when water is flowing therethrough, said abutment and guide means confining the flexible hose in a generally U-shaped configuration within the housing for supporting the shower head at any preselected position along the slot by exerting force against the housing side walls, a shower head;

means for slidably mounting said shower head along the slot for enabling adjustment of the height of the shower head from a shower floor when the housing is mounted to a shower wall with the slot in a generally vertical orientation, said means for slidably mounting said shower head along the slot including bracket means disposed behind said housing front panel for slidably engaging said housing sides; and flexible hose means for maintaining the position of the shower head along the housing slot, said flexible hose means interconnecting said shower head outlet and said shower head, and disposed behind said housing front panel and between said housing sides, said flexible hose means having a preselected length and radius of curvature to enable the shower head to be positioned along said slot from one end of the slot to another end of the slot while the flexible hose maintains contact with, and exerts force on, both said housing sides, said preselected length of the flexible hose means being sufficient to enable movement of said shower head along the slot from one end thereof to another end thereof while maintaining a single U-type loop in the flexible hose, said flexible hose means having sufficient resilience to both enable movement of said shower head along the slot and to stabilize the shower head along the slot during water flow through the shower head by exerting force against the housing side walls.

5. The shower track assembly of claim 4 wherein said housing sides include slot means for slidably engaging said bracket means.

* * * * *